US010832852B2

(12) United States Patent
Hundhammer et al.

(10) Patent No.: US 10,832,852 B2
(45) Date of Patent: Nov. 10, 2020

(54) FERRITE CORE, INDUCTIVE COMPONENT AND METHOD OF PRODUCING AN INDUCTIVE COMPONENT

(71) Applicant: SUMIDA Components & Modules GmbH, Obernzell (DE)

(72) Inventors: Stefan Hundhammer, Osterhofen (DE); Martin Grubl, Untergriesbach (DE); Helmut Rott, Thyrnau (DE)

(73) Assignee: SUMIDA COMPONENTS & MODULES GMBH, Obernzell (DE)

( * ) Notice: Subject to any disclaimer, the term of this patent is extended or adjusted under 35 U.S.C. 154(b) by 211 days.

(21) Appl. No.: 15/606,017

(22) Filed: May 26, 2017

(65) Prior Publication Data

US 2017/0352468 A1 Dec. 7, 2017

(30) Foreign Application Priority Data

Jun. 2, 2016 (DE) ..... 10 2016 209 693

(51) Int. Cl.
*H01F 17/04* (2006.01)
*H01F 27/26* (2006.01)
(Continued)

(52) U.S. Cl.
CPC ..... *H01F 27/266* (2013.01); *H01F 1/34* (2013.01); *H01F 27/255* (2013.01);
(Continued)

(58) Field of Classification Search
USPC ..... 336/212, 220, 221, 196, 178, 165
See application file for complete search history.

(56) References Cited

U.S. PATENT DOCUMENTS 4,897,916 A * 2/1990 Blackburn ..... H01F 27/245 29/609
5,671,526 A * 9/1997 Merlano ..... H01F 41/0233 29/609
(Continued)

FOREIGN PATENT DOCUMENTS

DE 112011103832 8/2013
DE 102014205044 10/2015
(Continued)

OTHER PUBLICATIONS

Official Communication dated May 3, 2017 in corresponding German application 10 2016 209 693.1, 12 pages.
(Continued)

*Primary Examiner* — Elvin G Enad
*Assistant Examiner* — Kazi S Hossain
(74) *Attorney, Agent, or Firm* — Fattibene and Fattibene LLC; Paul A. Fattibene

(57) ABSTRACT

A ferrite core comprising a yoke body having a length dimension, a width dimension and a height dimension, which are oriented perpendicular to one another, the length dimension being larger than the height dimension and/or the width dimension. A lateral surface of the yoke body has provided therein a positioning structure and an alignment structure, which differs from the positioning structure, the positioning and alignment structures being spaced apart along the length dimension by 5% to 75% of the length dimension.

9 Claims, 2 Drawing Sheets

Figure 1A:
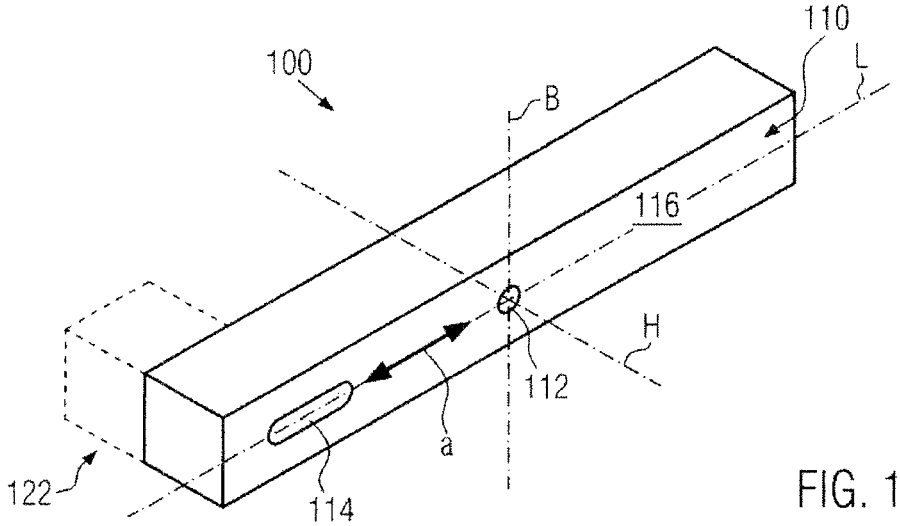

(51) Int. Cl.

| | |
|---|---|
| ***H01F 41/00*** | (2006.01) |
| ***H01F 1/34*** | (2006.01) |
| ***H01F 27/255*** | (2006.01) |
| ***H01F 27/28*** | (2006.01) |
| ***H01F 41/02*** | (2006.01) |

(52) U.S. Cl.
CPC ..... *H01F 27/2823* (2013.01); *H01F 41/00* (2013.01); *H01F 41/02* (2013.01)

(56) References Cited

U.S. PATENT DOCUMENTS

| | | | | |
|---|---|---|---|---|
| 5,945,902 | A | 8/1999 | Lipkes et al. | 336/200 |
| 7,701,320 | B2 | 4/2010 | Iwakura et al. | 336/212 |
| 8,120,458 | B2 | 2/2012 | Iwakura et al. | 336/198 |
| 9,099,236 | B2 | 8/2015 | Nomura et al. | H01F 27/008 |
| 9,620,277 | B2 | 4/2017 | Grubl et al. | |
| 2009/0147541 | A1* | 6/2009 | Shimada | H01F 27/38 363/15 |
| 2015/0780051 | | 9/2015 | Grubl et al. | H01F 27/255 |

FOREIGN PATENT DOCUMENTS

| | | |
|---|---|---|
| EP | 1717825 | 11/2006 |
| FR | 2118872 | 8/1972 |
| JP | S54119628 | 8/1979 |
| JP | H0818603 | 7/1996 |
| JP | 2003324016 | 11/2003 |
| WO | WO 9916093 | 4/1999 |

OTHER PUBLICATIONS

Search Report/Action dated Nov. 21, 2017 in corresponding European application 17173399.1 , 9 pages.

* cited by examiner

FERRITE CORE, INDUCTIVE COMPONENT AND METHOD OF PRODUCING AN INDUCTIVE COMPONENT

The present invention relates to a ferrite core, an inductive component comprising such a ferrite core and a method of producing such an inductive component.

Normally, inductive components have a coil, which is often defined by a magnetic core having at least one winding. Examples for inductive components are chokes and transformers.

The magnetic core of an inductive component often consists of a ferromagnetic material, such as iron powder or ferrite, and serves to guide the magnetic field while increasing simultaneously the magnetic coupling between the windings and between the turns of individual windings, the winding consisting of a conductive material, such as copper or aluminum, and being defined by a flat wire, a round wire, a stranded wire or a foil wire.

Although transformers and chokes have similar structural designs, they are used in different fields of application. Normally, chokes are low-impedance coils for reducing high-frequency currents on electric lines and are used in the field of the power supply of electric and electronic devices, in power electronics and high-frequency technology. Transformers, however, usually serve to increase or reduce alternating voltages, the input terminals and output terminals of transformers being usually galvanically separated.

The demands to be fulfilled by electronic and electric circuits in modern applications increasingly necessitate a miniaturization, so as to provide more compact structural designs of electric and electronic components in combination with lower losses and maximum capacities, along with a flexible adjustment to different voltage sources. For many applications it is, for example, desirable that the operation of the electric and electronic circuit units is independent of fluctuations in a supply voltage.

The challenges entailed by miniaturization can, however, only be dealt with satisfactorily when the losses and tolerances in the production of individual components are kept as low as possible or are largely compensated for. As far as inductive components are concerned, this means that the properties predetermined for these components, such as geometric dimensions and physical parameters (e.g. inductance, heat conduction and the like), are subjected to the least possible variations and, in other words, deviate from predetermined target values as little as possible.

A demand which has to be satisfied in many applications of inductive components or modules is that the inductive components/modules have to be positioned and/or aligned as precisely as possible relative to a base or support plate and/or other components. Without an accurate positioning and/or alignment of inductive components/modules, it is impossible to obtain acceptable tolerances as regards the electric characteristics of the inductive components/modules. Moreover, inaccurate positioning and/or alignment of individual inductive components/modules during production may lead to mounting problems in subsequent mounting processes, e.g. to a collision with neighboring components.

A further example of production-induced tolerances which occur in the manufacture of inductive components (and which cannot be avoided despite all optimization) are length tolerances of core bodies formed of a ferrite material. In the production of ferrite cores, a usually powdery ferrite material is press-formed into a desired shape and sintered in a subsequent temperature step. Due to thermally-conditioned changes of length (the behavior of a substance/material with respect to variations of its dimensions in response to temperature changes is described by the coefficient of thermal expansion, which is a substance-specific material constant), tolerances of ±2.5% have to be expected in the sintering process.

Reference DE 10 2014 205 044 A1 shows a core body consisting of a ferromagnetic material, the core body comprising a cross yoke having a length dimension and a width dimension. A ratio of length dimension to width dimension is here greater than 1. The core body additionally comprises a core leg, which extends laterally away from the cross yoke along an extension direction, the extension direction being oriented perpendicular to the length dimension and the width dimension. In addition, the cross yoke is provided with an alignment recess formed in a rear surface of the cross yoke. The rear surface is here arranged on a cross yoke side which is opposed to the at least one core leg.

Taking the above-described prior art as a basis, a ferrite core, an inductive component comprising such a ferrite core and a method of producing such an inductive component are to be provided, with the ferrite core being positioned and aligned with the highest possible degree of accuracy, independently of production tolerances as far as possible.

According to a first aspect, the above-described object is achieved by a ferrite core comprising a yoke body having a length dimension, a width dimension and a height dimension, which are oriented perpendicular to one another, the length dimension being larger than the height dimension and/or the width dimension. A lateral surface of the yoke body has provided therein a positioning structure and an alignment structure, which differs from the positioning structure, said positioning and alignment structures being spaced apart along the length dimension by 5% to 75% of the length dimension. Alignment means here the proper positioning or state of adjustment of parts in relation to each other.

According to an illustrative embodiment, the positioning structure is configured as a conical or cylindrical or polyhedral recess. This allows an easy implementation of the positioning structure as a recess in the ferrite core, which can easily be provided at the ferrite core without any risk of causing damage to the ferrite core.

According to a further illustrative embodiment, the alignment structure is configured as an elongate recess. According to a more advantageous further development thereof, the elongate recess extends along the length dimension. By means of the alignment structure configured as an elongate recess, it is possible to provide the alignment structure independently of tolerances of the length dimension for a plurality of ferrite cores in series production.

According to a further illustrative embodiment, the recess of the positioning structure and/or of the alignment structure has a depth dimension, which is smaller than a largest dimension of the recess of the positioning structure and/or the alignment structure perpendicular to the depth dimension. Thus, advantageous positioning and/or alignment structures are provided, through which magnetic flux guidance in the ferrite core during operation is influenced to the least possible extent.

According to another illustrative embodiment, the positioning structure is arranged in a range of up to 10% of the length dimension around the center of area of the lateral surface. This represents an advantageous reference point for positioning in series production, so that the ferrite core can be positioned with the highest possible precision.

According to a further illustrative embodiment, the positioning structure and the alignment structure are spaced apart by 40% to 50% of the length dimension. This allows improved precision as regards the alignment.

According to a further aspect of the present invention, an inductive component is provided, which comprises a support structure and a ferrite core according to the above aspect as well as at least one winding over the ferrite core. The ferrite core is here held by the support structure, the positioning structure entering into engagement with a positioning element provided on the support structure, and the alignment structure entering into engagement with an alignment element provided on the support structure. In this way, an inductive component with precise positioning and alignment of the ferrite core relative to the support structure is provided.

According to an illustrative embodiment, the positioning element and the alignment element are each configured as a cylindrical or conical or polyhedral pin. The positioning element and the alignment element can thus easily be implemented.

According to a further illustrative embodiment, the alignment structure has, along a connection direction between the positioning element and the alignment element, a dimension which is larger than a further dimension of the alignment structure in the lateral surface perpendicular to the connection direction. This allows precise alignment, irrespectively of possible tolerances, along the connection direction.

According to a further aspect of the present invention, a method of producing an inductive component according to the above aspect is provided. The method comprises providing a ferrite core according to the above aspect, arranging the ferrite core on a support structure, and arranging at least one winding over the ferrite core. The arranging of the ferrite core on the support structure comprises the steps of bringing the positioning structure into engagement with a positioning element provided on the support structure and bringing the alignment structure into engagement with an alignment element provided on the support structure, or the arranging of the ferrite core on the support structure is carried out by means of a mounting device, said mounting device comprising a positioning element and an alignment element, which are brought into engagement with the positioning structure and the alignment structure in a suitable manner.

According to an illustrative embodiment, the positioning structure is brought into engagement with the positioning element before the alignment structure is brought into engagement with the alignment element. Hence, the yoke body is first positioned, whereupon the yoke body is aligned with respect to a further yoke body and/or the support structure.

According to a further illustrative embodiment, the positioning element and the alignment element are each configured as a cylindrical or conical or polyhedral pin. Advantageous elements for the purpose of positioning and alignment are provided in this way.

According to a further illustrative embodiment, the alignment structure has, along a connecting direction between the positioning element and the alignment element, a dimension which is larger than a further dimension of the alignment structure in the lateral surface perpendicular to the connection direction.

Figure 1B:
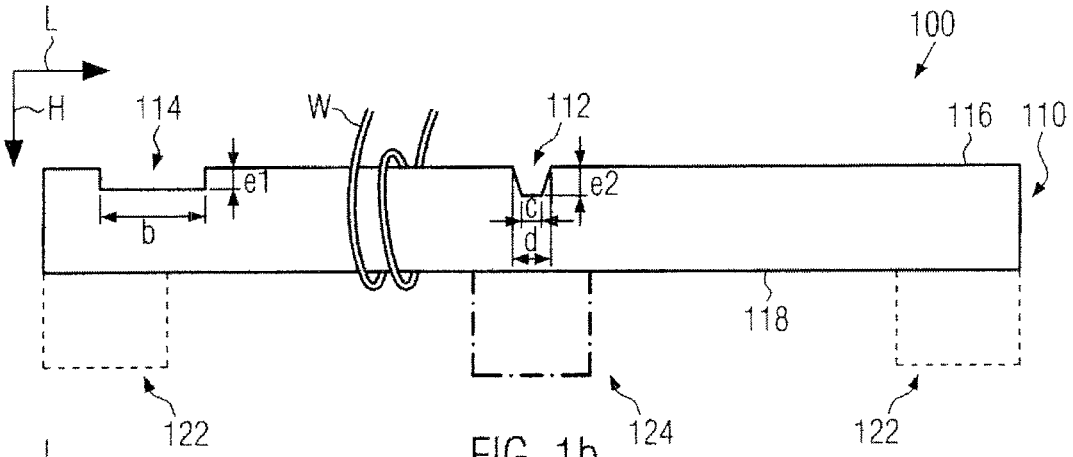

The above described aspects and embodiments will now be described with respect to various illustrative further developments on the basis of the figures enclosed:

FIG. 1*a* shows a perspective view of a ferrite core according to a few illustrative embodiments;

FIG. 1*b* shows a cross-sectional view of FIG. 1*a;*

Figure 1C:
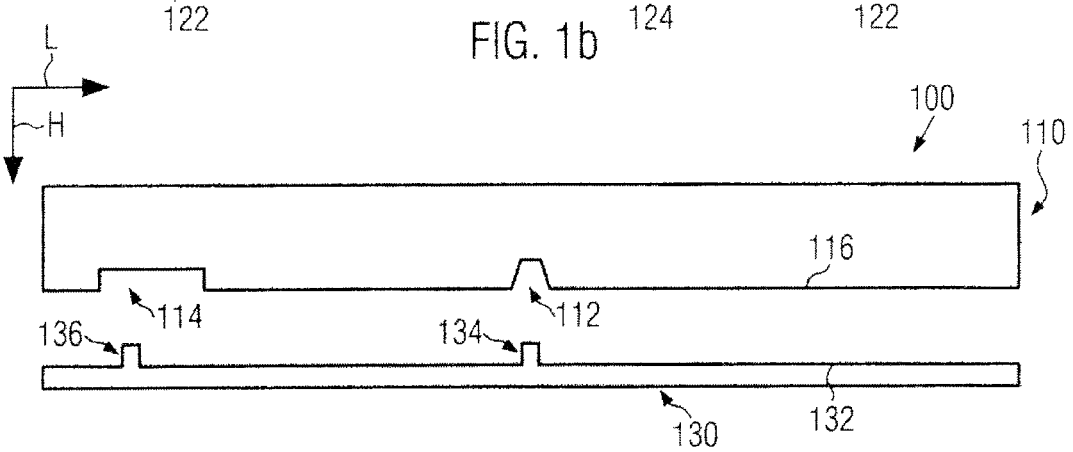
Figure 2:
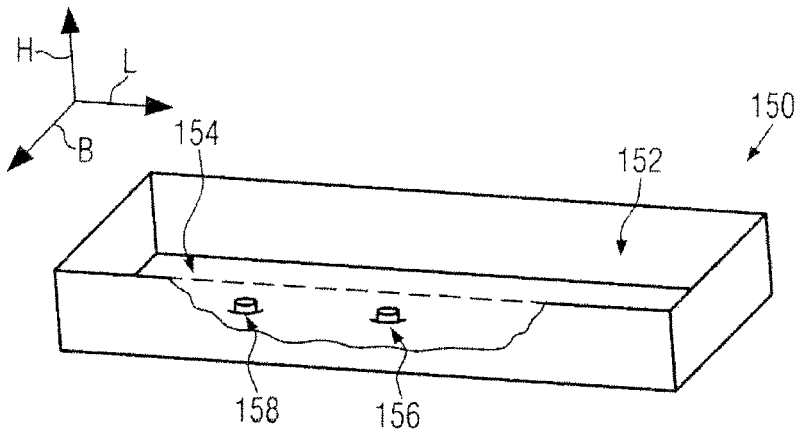
Figure 3A:
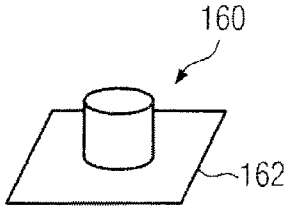
Figure 3B:
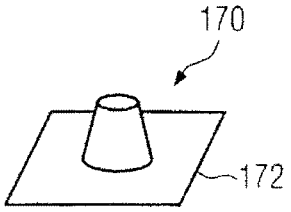
Figure 3C:
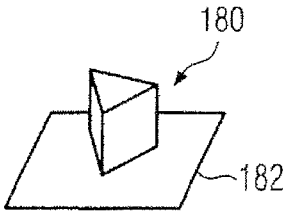

FIG. 1*c* shows, in a schematic cross-sectional view, an enlarged representation of an arrangement comprising a ferrite core and a support structure according to illustrative embodiments of the present invention;

FIG. 2 shows schematically, in a perspective view, a mounting device according to illustrative embodiments of the present invention; and FIG. 3*a*-3*c* show in schematic, perspective views a positioning structure and/or an alignment structure according to various embodiments of the present invention.

FIG. 1 shows schematically, in a perspective view, a ferrite core 100 with a yoke body 110 having along a length direction L a length dimension, along a width direction B a width dimension and along a height direction H a height dimension. The yoke body 110 may e.g. have the shape of a rod, and a ratio of the height dimension to the length dimension as well as a ratio of the width dimension to the length dimension may be smaller than one (<1). According to illustrative examples, the length dimension may at least be twice or three times or five times or ten times as large as the width dimension and/or the height dimension. According to special exemplary embodiments, the following may hold true:

length dimension>width dimension=height dimension, length dimension>width dimension>height dimension, or length dimension>height dimension>width dimension.

In a lateral surface 116 of the yoke body 110, a positioning structure 112 and an alignment structure 114, which differs from the positioning structure 112, are provided, which are spaced apart along the length direction L (and in particular along the length dimension) by a distance a. According to illustrative embodiments, the following holds true for said distance a: 5% of the length dimension<a<75% of the length dimension. In the case of special illustrative examples, said distance a may lie in a range between 5% of the length dimension and 50% of the length dimension. According to a special example, the distance a lies within a range of 25% of the length dimension to 50% of the length dimension, e.g. in a range of 30% of the length dimension to 40% of the length dimension.

According to an illustrative embodiment, the lateral surface 116 may be a rear lateral surface of the ferrite core 100. According to an illustrative example, a lateral surface, which is opposed to the lateral surface 116, may have arranged thereon at least one leg 122, as indicated by broken lines in FIG. 1*a*. The at least one leg 122 may be formed integrally with the yoke body 110. Alternatively, the at least one leg 122 may be glued onto the yoke body 110.

FIG. 1*b* shows a cross-sectional view of the yoke body 110 according to FIG. 1*a* in a plane defined by the length direction L and the height direction H and extending through the positioning structure 112 and the alignment structure 114.

According to the illustrative embodiment shown in FIG. 1*b*, the positioning structure 112 and the alignment structure 114 may each be configured as a recess in the lateral surface 116. This does not represent a limitation of the present invention, and the positioning structure and/or the alignment structure 114 may be configured as a structure projecting from the lateral surface 116, such as a protrusion, a stud, a projecting pin, a bulge, etc.

According to an illustrative embodiment of the present invention, the positioning structure 112 may be configured as a conical or frustoconical recess. Alternatively, the positioning structure 112 may be configured as a cylindrical recess. This does not represent a limitation of the present invention and the positioning structure may alternatively also be configured as a pyramid-shaped recess or, quite generally, as a recess having a polygonal cross-section, i.e. a recess which is polyhedral in shape.

According to an illustrative embodiment of the present invention, the alignment structure 114 may be configured as an elongate recess. This means that an extension dimension of the alignment structure 114 along the width direction B may be smaller than an extension dimension of the alignment structure 114 along the length direction L. In illustrative examples, aspect ratios of the dimensions of the alignment structure 114 according to the ratio of length dimensions (i.e. a dimension along the length direction L) to width dimension (i.e. a dimension along the width direction B) may be greater than 2, e.g. greater than 5, or, as a further example, greater than 10. This allows a precise alignment of the yoke body 110 along the width direction B with little fault tolerance. In particular, a tolerance in a direction of rotation with the positioning structure 112 as a center of rotation is implemented by a small aspect ratio to the alignment structure 114. It follows that, in addition to a precise positioning of the yoke 110 by means of the positioning structure 112, it is possible to accomplish, relative to the positioning structure 112, high precision with respect to an azimuthal alignment relative to the center of rotation through the alignment structure 114.

According to the representation shown in FIG. 1*b*, the alignment structure 114 has an extension dimension in the length direction L, which is designated by the reference symbol "b". As will be explained hereinafter with respect to a positioning and alignment of the ferrite core 100 relative to a support structure (not shown in FIG. 1*b*), e.g. a printed circuit board, or a mounting device (not shown in FIG. 1*b*), a tolerance of the yoke body 110 caused by length contractions, which occur during sintering, can be compensated for by means of the extension dimension b.

According to the representation shown in FIG. 1*b*, the positioning structure 112 has, at the bottom of the positioning structure 112, an extension dimension in the length direction L, which is designated by reference symbol "c" in FIG. 1*b*. An extension dimension of the positioning structure 112 in the length direction L directly at the surface of the lateral surface 116 is designated by reference symbol "d" in FIG. 1*b*. In the case of a tapering recess of the positioning structure 112, the extension dimension of the positioning structure 112 may decrease ($c<d$) as the depth (along the height direction) of the positioning structure 112 increases. This does not represent a limitation. According to some alternative embodiments (not shown), $c=d$ may hold true.

According to respective illustrative embodiments, e.g. the following may hold true: $a>b>d$.

According to illustrative embodiments, e.g. the following may hold true: $b/a<0.5$ (e.g. $b/a<0.3$ or $b/a<0.2$ or $b/a$ 0.15). Additionally or alternatively, the following may hold true: $c/b<0.5$ (e.g. $c/b<1/3$ and/or $0.4>c/b$). Additionally or alternatively, the following may hold true: $d/b<0.5$ (e.g. $d/b<1/3$ and/or $0.4>d/b>0.25$). Additionally or alternatively, the following may hold true: $c/d<1$ (e.g. $c/d<0.8$ and/or $0.5<c/d<0.8$).

According to illustrative embodiments, a depth of the positioning structure (in FIG. 1*b* designated by reference symbol "e2") may be chosen such that, during operation of the ferrite core 100 in an inductive component (not shown), the least possible influence will be exerted on a field line profile within the yoke body 110. Likewise, a depth of the alignment structure 114 (in FIG. 1*b* designated by reference symbol "e1") may be chosen such that, during use of the ferrite core 100 in a magnetic component (not shown), the least possible influence will be exerted on a field line profile within the yoke body 110. "Least possible" may be a fault tolerance of less than 10%, less than 5% or less than 1%. According to special examples, the following may hold true: $e1=e2$. This does not represent a limitation of the present invention, and it is possible to choose different depths for the positioning structure 112 and the alignment structure 114, i.e. $e1\neq e2$. In some special examples thereof, the following may hold true: $e2>e1$.

On a lateral surface 118 located opposite the lateral surface 116, at least one leg may be arranged: in exemplary embodiments, two lateral legs 122 and/or a central leg 124 may be provided, as indicated by broken lines and by a dot-and-dash line in FIG. 1*b*. The at least one leg 122, 124 may be formed integrally with the yoke body 110 by sintering for providing a ferrite core 100. Alternatively, the legs may be glued onto a rodshaped yoke body 110.

According to an illustrative embodiment of the present invention, the yoke body 110 may have provided thereon at least one winding W. The winding W may, for example, be arranged on a support structure (not shown) and/or a further ferrite core (not shown, may be configured similarly to the ferrite core 100) prior to positioning and aligning the ferrite core 100.

FIG. 1*c* shows how the yoke body 110 is positioned and aligned on a support structure 130, such as a printed circuit board, an electronic board and the like. On a surface 132 of the support structure 130 facing the lateral surface 116, the support structure 130 has provided thereon elements for aligning and positioning the yoke body 110 on the support structure 130. In particular, a positioning element 134 for entering into engagement with the positioning structure 112 and an alignment element 136 for entering into engagement with the alignment structure 114 are formed on said surface 132. According to an illustrative example, the positioning element 134 is configured such that it engages the positioning structure 112 in a precisely fitting manner. In the cross-sectional view of an illustrative embodiment shown in FIG. 1*c*, the positioning element 134 may be configured as a cylindrical or conical or polyhedral pin that projects from the surface 132 of the support structure.

According to an illustrative embodiment of the present invention, the surface 132 has additionally formed thereon an alignment element 136, which, similar to the positioning element 134, projects from the surface 132 as a cylindrical or conical or polyhedral pin. While the precisely fitting complementariness between the positioning structure 112 and the positioning element 134 allows to accomplish a very precise positioning of the yoke body 110 on the support structure 130, a very precise alignment of the yoke body 110 on the support structure 130 is accomplished by bringing the alignment element 136 into engagement with the alignment structure 114. The extension dimension b of the alignment structure 114 (cf. FIG. 1) allows a compensation of tolerances in the length dimension of the yoke body 110, which are caused by the production process. Precise positioning and alignment of the yoke body 110 on the surface 132 of the support structure 130 is thus provided irrespectively of production tolerances in the length dimension of the yoke body 110, caused e.g. by linear thermal expansion and the like.

According to an illustrative embodiment of the present invention, the positioning structure 112 may be configured in a center of area of the surface 116 of the yoke body 110. Alternatively, the positioning structure 112 may be arranged in a range of 10% of the length dimension around the center of area of the lateral surface 116.

According to an illustrative embodiment, the positioning structure 112 and the alignment structure 114 are arranged along the length direction L in the lateral surface 116.

According to an illustrative embodiment, the alignment structure 114 is arranged along a connecting direction between the positioning element 134 and the alignment element 136 relative to the positioning structure 112 and has in the connecting direction a dimension which is larger than a further dimension of the alignment structure 114 in the lateral surface 116 perpendicular to the connecting direction, in particular the width direction B.

With respect to FIG. 1*c*, a method of producing an inductive component will now be described. According to this method, a ferrite core 100 comprising a yoke body 110 is provided. The ferrite core 100 may have provided thereon at least one winding W. The ferrite core is arranged on the support structure 130, said arranging of the ferrite core 100 on the support structure 130 comprising the steps of bringing the positioning structure 112 into engagement with a positioning element 134 provided on the support structure 130 and bringing the alignment structure 114 into engagement with an alignment element 136 provided on the support structure 130.

According to an illustrative embodiment, the positioning structure 112 is brought into engagement with the positioning element 134 before the alignment structure 114 is brought into engagement with the alignment element 136. Alternatively, the positioning structure may be brought into engagement with the positioning element precisely when the alignment structure is brought into engagement with the alignment element.

FIG. 2 shows, in a perspective view, schematically a mounting device 150, which is adapted for use in the production of an inductive component for producing a ferrite core (e.g. the ferrite core 100 according to FIGS. 1*a* to 1*c*). The mounting device 150 may comprise a trough-shaped depression 152 whose bottom area 154 may have formed therein elements for positioning and aligning a ferrite core (e.g. the ferrite core 100 according to FIGS. 1*a* to 1*c*). According to a special example, the mounting device 150 may comprise a trough-shaped or cup-shaped element with a holding or gripping structure (not shown), e.g. a handle and/or a suction attachment, etc., so that the mounting device can be positioned manually or mechanically.

According to an illustrative embodiment, a positioning element 156 and an alignment element 158 may be provided in the bottom area 154 of the mounting device 150, so as to enter into engagement with complementary positioning and alignment structures on the ferrite core. According to exemplary embodiments, the positioning element 156 and the alignment element 158 may each be configured as a cylindrical or conical or polyhedral pin, e.g. similar to the positioning and alignment elements 134 and 136 described above in connection with the support structure 130 with respect to FIG. 1*c*. The trough-shaped depression 152 may be used as part of the mounting device 150, which is not shown in detail, for positioning and aligning a yoke body (e.g. the yoke body 110 according to FIG. 1*a* to 1*c*) with respect to a further yoke body (similar to the yoke body 110 described hereinbefore with respect to FIGS. 1*a* to 1*c*). In so doing, a yoke body may be received in the trough-shaped depression 152, the positioning element 156 and the alignment element 158 being brought into engagement with complementary positioning and alignment structures (cf. for example, 112 and 114 in FIG. 1*a* to 1*c*) of the yoke body. An exact positioning and alignment of a yoke body within the trough-shaped depression 152 and, consequently, relative to the mounting device 150 is thus precisely defined.

With respect to FIGS. 3*a* to 3*c*, exemplary embodiments for a positioning element and/or an alignment element will now be described in more detail.

FIG. 3*a* shows a positioning and/or alignment element 160 formed on a surface 162 of a support structure (not shown) or a mounting device (not shown). The positioning and/or alignment element 160 is configured as a cylindrical pin according to the representation in FIG. 3*a*.

FIG. 3*b* shows a positioning and/or alignment element 170 formed on a surface 172 of a support structure (not shown) or a mounting device (not shown). The positioning and/or alignment element 170 is configured as a conical or frustoconical pin according to the representation in FIG. 3*b*.

FIG. 3*c* shows a positioning and/or alignment element 180 formed on a surface 182 of a support structure (not shown) or a mounting device (not shown). The positioning and/or alignment element 180 is configured as a wedge-shaped pin according to the representation in FIG. 3*c*. This does not represent a limitation, and the pin 180 may be configured as a general polyhedral body, e.g. as a tetrahedron, a pyramid, a truncated pyramid, etc., and combinations thereof.

A support structure described with respect to various embodiments hereinbefore may, according to illustrative examples of the present invention, be configured as a base plate or carrier. For example, a base plate may act as a carrier. Additionally or alternatively, the support structure may comprise a housing. For example, a base plate may represent part of a housing into which at least a ferrite core or an inductive component with the ferrite core is to be introduced at least partially.

According to some illustrative embodiments, the support structure may be configured as an injection molded plastic part, the positioning and alignment elements being here easy to implement. Alternatively, it may be formed by means of extrusion molding. According to a special example, the support structure may be configured as a base plate formed as an injection molded part, or it may at least comprise a correspondingly formed base plate.

What is claimed is:

1. An inductive component comprising a support structure, a ferrite core with a yoke body having a length dimension, a width dimension and a height dimension, which are oriented perpendicular to one another, the length dimension being larger than the height dimension and/or the width dimension, wherein a lateral surface of the yoke body has provided therein a positioning structure and an alignment structure, which differs from the positioning structure, the positioning and alignment structures being spaced apart along the length dimension by 5% to 75% of the length dimension, the alignment structure being configured as an elongated recess which is closed in on four sides, and at least one winding over the ferrite core, wherein the ferrite core is held by the support structure, wherein the positioning structure enters into engagement with a positioning element provided on the support structure, and wherein the alignment structure enters into engagement with an alignment element provided on the support structure.

2. The inductive component according to claim 1, wherein the positioning element and the alignment element are each selected from the group consisting of a cylindrical, conical, and polyhedral pin.

3. The inductive component according to claim 1, wherein, along a connection direction between the positioning element and the alignment element, the alignment structure has a length dimension which is larger than a width dimension of the alignment structure in the lateral surface perpendicular to the connection direction.

4. A ferrite core for an inductive component comprising:

a ferrite yoke body having a length, width, and height dimension and a lateral surface with opposing longitudinal edges;

a positioning structure comprising a recess placed between the opposing longitudinal edges on the lateral surface of said yoke body, said positioning structure defining a position location on the lateral surface in the length, width, and height dimensions of said ferrite yoke body; and an alignment structure comprising an elongated recess having an extension dimension along the length of said ferrite yoke body and closed in on four sides between the opposing longitudinal edges on the lateral surface of said ferrite yoke body, said alignment structure defining an alignment location along a portion of the length dimension of said ferrite yoke body, said alignment structure spaced from said positioning structure by a distance of between five and seventy-five percent of the length of said ferrite yoke body;

a support structure;

a positioning element projecting from and placed on said support structure positioned to mate with said positioning structure on the lateral surface of said ferrite yoke body; and an alignment element projecting from and placed on said support structure positioned to mate with said alignment structure on the lateral surface of said ferrite yoke body, said alignment element having a dimension along the length of said ferrite yoke body substantially less than the extension dimension of said alignment structure along the length of said ferrite yoke body so that, when said alignment element is mated with said alignment structure, a space is formed between two opposing sides in the extension direction of the four sides of said alignment structure sufficient to compensate for tolerance changes in the length of said ferrite yoke body caused by production, whereby said ferrite yoke body is capable of being positioned and aligned accurately independent of production tolerances along the length of said ferrite yoke body.

5. The inductive component according to claim 1, wherein the positioning structure is selected from the group consisting of a conical, cylindrical, and polyhedral recess.

6. The inductive component according to claim 1, wherein the elongate recess extends along the length dimension.

7. The inductive component according to claim 1, wherein the recess of the positioning structure and/or of the alignment structure has a depth dimension, which is smaller than a largest dimension of the recess of the positioning structure and/or the alignment structure perpendicular to the depth dimension.

8. The inductive component according to claim 1, wherein the positioning structure is arranged in a range of 10% of the length dimension around the center of area of the lateral surface.

9. The inductive component according to claim 1, wherein the positioning structure and the alignment structure are spaced apart in a range of 40 to 50% of the length dimension.

* * * * *